US007396219B2

(12) United States Patent
Berwanger

(10) Patent No.: US 7,396,219 B2
(45) Date of Patent: Jul. 8, 2008

(54) DISCHARGE TUBE OF HERMETIC COMPRESSOR

(75) Inventor: Egidio Berwanger, Joinville (BR)

(73) Assignee: Empresa Brasiliera De Compressores S.A. - Embraco, Joinville-SC (BR)

( * ) Notice: Subject to any disclaimer, the term of this patent is extended or adjusted under 35 U.S.C. 154(b) by 0 days.

(21) Appl. No.: 10/543,798

(22) PCT Filed: Feb. 16, 2004

(86) PCT No.: PCT/BR2004/000011

§ 371 (c)(1),
(2), (4) Date: Sep. 16, 2005

(87) PCT Pub. No.: WO2004/074684

PCT Pub. Date: Sep. 2, 2004

(65) Prior Publication Data

US 2006/0110269 A1 May 25, 2006

(30) Foreign Application Priority Data

Feb. 18, 2003 (BR) ..... 0300607

(51) Int. Cl.
*F04B 39/00* (2006.01)
*F04B 53/00* (2006.01)

(52) U.S. Cl. ..... 417/902; 417/312; 181/403

(58) Field of Classification Search ..... 417/312, 417/902

See application file for complete search history.

(56) References Cited

U.S. PATENT DOCUMENTS

| | | | | |
|---|---|---|---|---|
| 5,173,034 | A * | 12/1992 | Riffe | 417/312 |
| 5,328,338 | A * | 7/1994 | Hirano et al. | 417/312 |
| 5,431,518 | A * | 7/1995 | Young et al. | 411/429 |
| 5,722,818 | A * | 3/1998 | Ohta et al. | 417/312 |
| 5,762,479 | A | 6/1998 | Baars et al. | |
| 6,374,943 | B1 * | 4/2002 | Choi | 181/229 |

FOREIGN PATENT DOCUMENTS

| | | |
|---|---|---|
| EP | 1 106 832 A2 | 6/2001 |
| FR | 60 988 | 2/1955 |

* cited by examiner

*Primary Examiner*—Anthony D. Stashick
*Assistant Examiner*—Patrick Hamo
(74) *Attorney, Agent, or Firm*—Darby & Darby P.C.

(57) ABSTRACT

A mounting arrangement for a discharge tube of a hermetic compressor is provided having a hermetic shell presenting a gas outlet and lodging a cylinder block in which is affixed, through screws, a cylinder head defining, internally, a gas discharge chamber, and a discharge tube presenting an inlet end in fluid communication with the gas discharge chamber through an orifice in the cylinder head, and an opposite end coupled to the gas outlet of the shell. The arrangement includes an electrically insulating discharge connector affixed to the cylinder head through one of the screws and receiving and securing the inlet end of the discharge tube.

5 Claims, 3 Drawing Sheets

DISCHARGE TUBE OF HERMETIC COMPRESSOR

CROSS REFERENCE TO PRIOR APPLICATION

This application is a U.S. National Phase Application under 35 U.S.C. §371 of International Application No. PCT/BR2004/000011, filed Feb. 16, 2004 and published in English, which claims priority from Brazilian Application No. PI 0300607-7, filed Feb. 18, 2003.

FIELD OF THE INVENTION

The present invention refers to a constructive solution applied to a discharge tube of a reciprocating hermetic compressor of the type used in small refrigeration systems, such as refrigerators, freezers, drinking fountains, etc.

BACKGROUND OF THE INVENTION

Reciprocating hermetic compressors consist of a motor-compressor assembly mounted in the interior of a hermetically sealed shell generally by suspension springs. The motor-compressor assembly comprises a cylinder block sustaining a vertical crankshaft carrying, medianly, a rotor of the electric motor of the compressor and, inferiorly, a pump rotor which conducts, during the operation of the compressor, lubricant oil from a reservoir provided in a lower portion of the shell of the compressor to the parts with relative movement, in order to form an oil film between said parts, avoiding the wearing contact therebetween.

These compressors present a connecting rod mounted, at one end, to an eccentric of the crankshaft and, at the other end, to a piston reciprocating in the interior of a cylinder orthogonally in relation to the axis of the eccentric between a lower dead point condition and an upper dead point condition, which are respectively defined by a maximum and a minimum linear spacing between the piston top and a valve plate mounted to a cylinder end and which defines the internal face of a cylinder head assembly defining suction and discharge chambers of the compressor.

When driven by the electric motor, the piston is reciprocally displaced inside the cylinder, drawing and compressing the refrigerant gas.

The hermetic shell further carries a discharge duct or tube presenting an internal end affixed to the cylinder head and opened to the discharge chamber, and an opposite end opened to an orifice provided on the surface of the hermetic shell, communicating the discharge chamber with the high pressure side of a refrigerating system to which the compressor is connected.

When an insulation failure occurs in the motor of a compressor, there occurs leakage of electric current, which has two paths to follow: through the suspension springs or through the discharge tube.

The current leakage mostly occurs in three possible situations: the refrigeration appliance to which the compressor is associated is not grounded and the user experiences electric shocks with life risks; said refrigeration appliance is grounded and a moderated current passes through the grounding system, causing degradation of the electrodes and increasing energy consumption; and said refrigeration appliance is grounded and a high current passes through the system without being detected by the thermal protector, jeopardizing the installation.

Nowadays it is usual the provision of insulating stop means, such as plastic stop means, in the suspension springs, aiming at reducing the passage of noise. Besides the function to which they are intended, such stop means also actuate as electric insulators, preventing the passage of electric current to the shell of the compressor. In such constructions, insulation failures generate electric current leakage through the discharge tube.

OBJECTS OF THE INVENTION

Thus, it is the generic object of the present invention to provide a mounting arrangement for a discharge tube of a hermetic compressor, which overcomes the deficiencies mentioned above, avoiding the occurrence of electric current leakage to the shell of the compressor through the discharge tube thereof.

It is a further object of the present invention to provide a discharge arrangement as mentioned above, which allows obtaining an electric insulation between the electric motor and the shell of the compressor, with a solution which is simple to apply in a production line and also in compressors already in operation, without significantly altering the manufacturing process of said compressors.

SUMMARY OF THE INVENTION

These and other objects are attained by a mounting arrangement for a discharge tube of a hermetic compressor of the type which comprises: a hermetic shell presenting a gas outlet and lodging a cylinder block in which is affixed, through screws, a cylinder head defining, internally, a gas discharge chamber; and a discharge tube presenting an inlet end in fluid communication with the gas discharge chamber through an orifice in the cylinder head, and an opposite end coupled to the gas outlet of the shell.

The mounting arrangement of the present invention comprises a discharge connector, affixed to the cylinder head through one of the screws and receiving and securing the inlet end of the discharge tube, said discharge connector electrically insulating the discharge tube of the cylinder head.

The solution of the present invention allows obtaining an electric insulation of the compressor, minimizing the risks of accidents resulting from the existence of electric current leakage through the shell of the compressor.

BRIEF DESCRIPTION OF THE DRAWINGS

The invention will be described below, with reference to the enclosed drawings, in which.

DETAILED DESCRIPTION OF THE INVENTION

Figure 1:
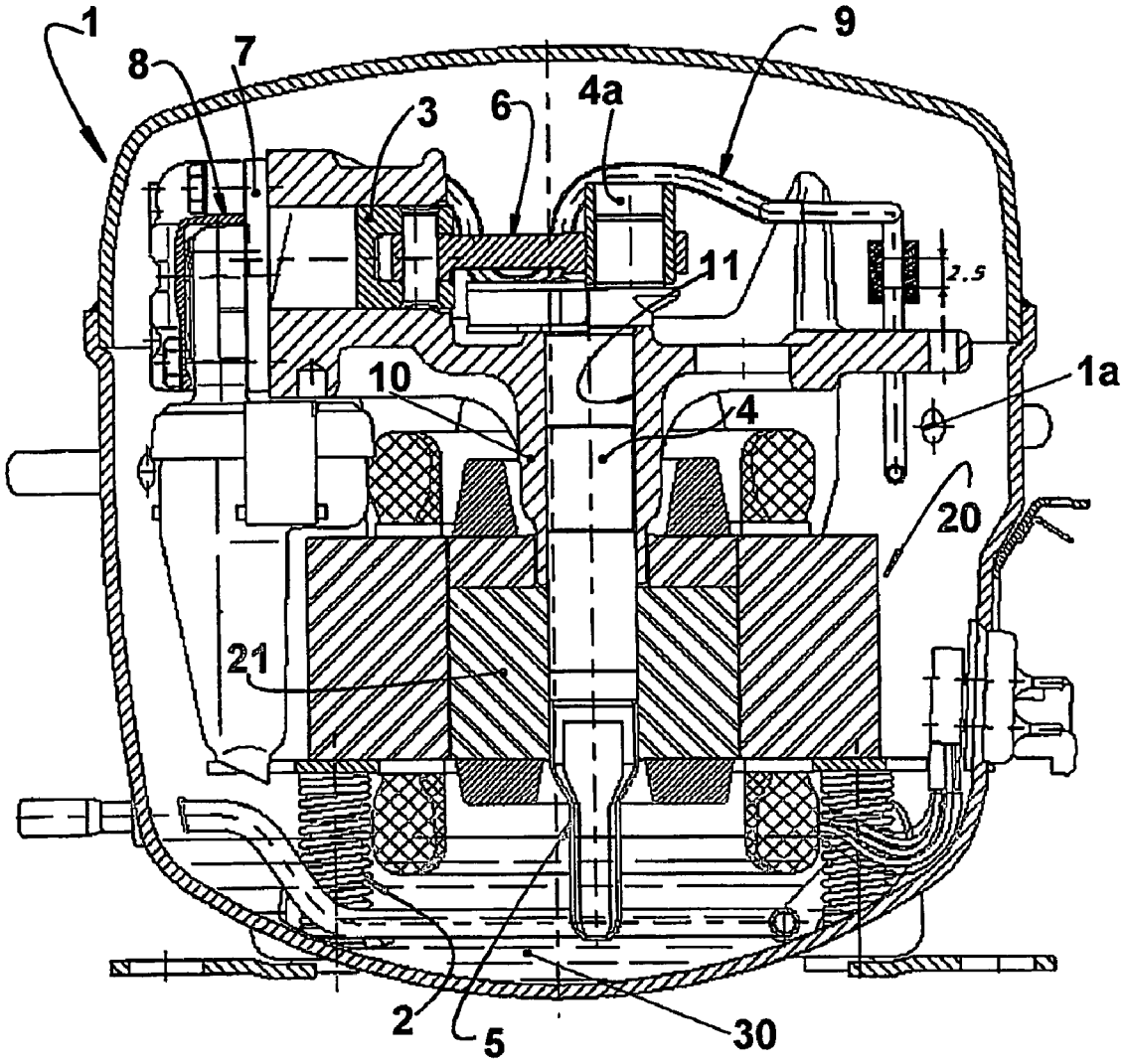
FIG. 1 represents, schematically and in a median vertical section, a compressor of the type used in the present invention.
Figure 2:
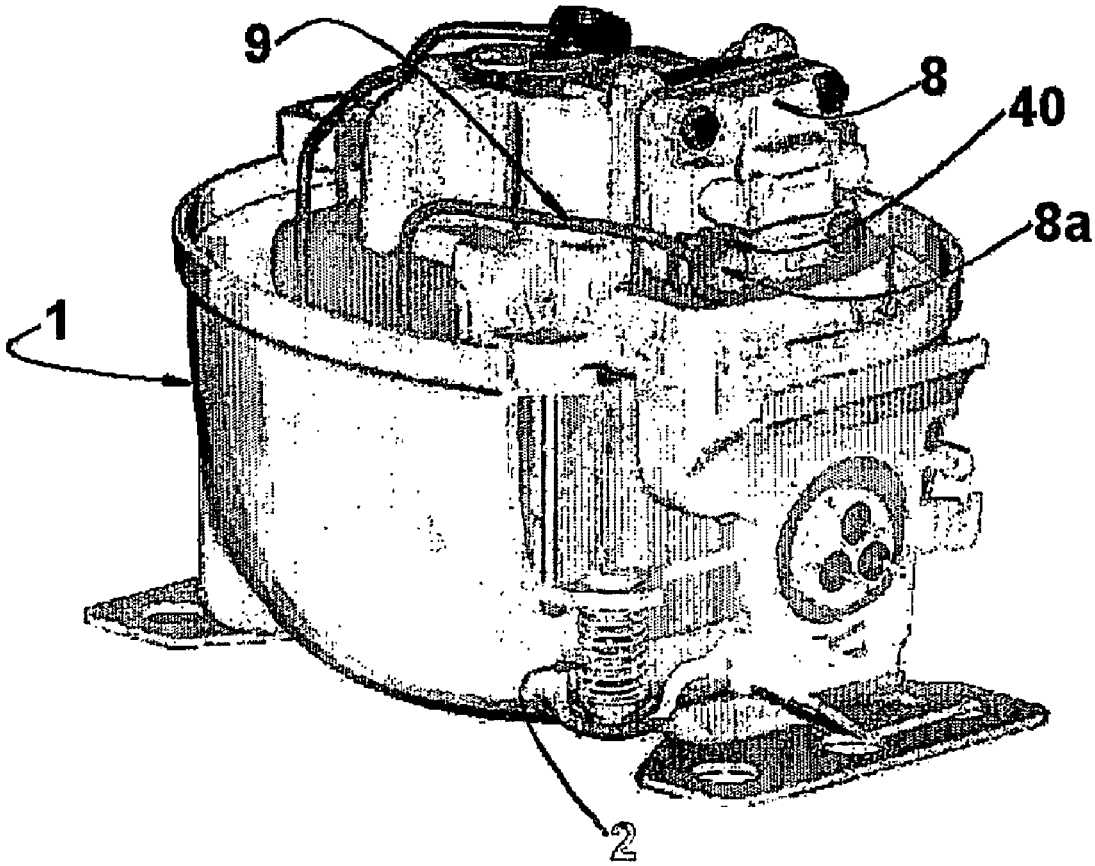
FIG. 2 represents, schematically and partially, the compressor illustrated in FIG. 1, with the upper part of the shell being removed therefrom.
Figure 3:
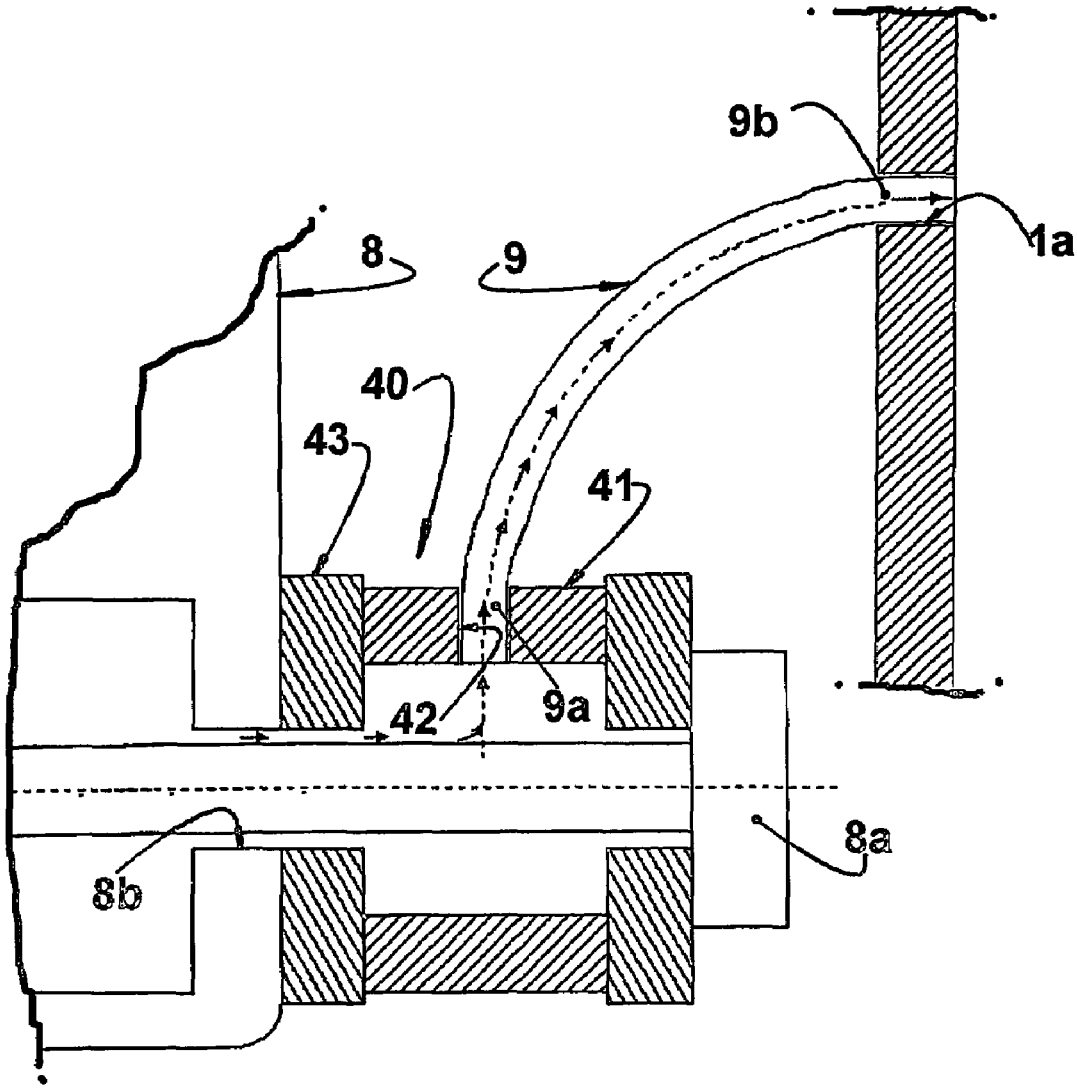
FIG. 3 represents, schematically, a sectional view of part of the cylinder head illustrating the connection region of the discharge tube.

The invention will be described in relation to a reciprocating compressor of the type comprising a hermetic shell 1, inside which is suspended, by means of springs 2, a motor-compressor assembly including a cylinder block 10 in which a cylinder 11 lodges a piston 3 reciprocating within said cylinder 11, drawing and compressing the refrigerant gas when driven by an electric motor 20.

The cylinder block 10 sustains a vertical crankshaft 4 carrying, medianly, a rotor 21 of the electric motor 20 of the compressor and, inferiorly, a pump rotor 5 which conducts, during the operation of the compressor, lubricant oil from a reservoir 30 provided in a lower portion of the hermetic shell 1 of the compressor, to the parts with relative movement, in order to form an oil film therebetween.

These compressors present a connecting rod 6 mounted, at one end, to an eccentric 4*a* of the crankshaft 4 and, at the other end, to the piston 3.

During the operation of the compressor, the piston 3 is displaced through the interior of the cylinder 11, orthogonally in relation to the axis of the eccentric 4*a*, between a lower dead point condition and an upper dead point condition, which are respectively defined by a maximum and a minimum linear spacing between the top of the piston 3 and a valve plate 7, mounted to an end of the cylinder 11 and which defines the internal face of a cylinder head 8 secured to the cylinder block 10 through screws 8*a*.

The cylinder head 8 defines, internally and with the valve plate 7, suction and discharge chambers that are maintained in selective fluid communication with the cylinder 11 through respective suction and discharge orifices. This selective communication is defined by the opening and closing of said suction and discharge orifices by the respective suction and discharge valves.

The hermetic shell 1 carries, therewithin, a discharge duct or tube 9 presenting an inlet end 9*a*, opened to the discharge chamber through an orifice 8*b* in the cylinder head 8, and an opposite end 99 coupled to a gas outlet 1*a* provided on the surface of the hermetic shell 1, communicating the interior of the hermetic shell 1 with the high pressure side of a refrigerating system to which the compressor is connected. The opposite end 9*b* of the discharge tube 9 is affixed to a discharge tube (not illustrated) mounted to the gas outlet 1*a* of the hermetic shell 1.

In this construction, the gas compressed in the cylinder 11 is directed to the discharge chamber mounted upon the opening of the discharge valve in the valve plate 4, being then conducted to the high pressure side of the refrigerating system through the discharge tube 9, which in this construction presents a determined length between the cylinder head 8 and the discharge tube in the hermetic shell 1.

The discharge tube 9 is generally produced in metallic material and affixed to the cylinder head 8 and to the hermetic shell 1 by welding. The fixation of the discharge tube 9 to the cylinder head 8 occurs through the mounting region of one of the screws 8*a* used for affixing the cylinder head 8 to the cylinder block 10, which affixes, to said cylinder head 8, a discharge connector 40 which receives and secures the inlet end 9*a* of the discharge tube 9.

According to the present invention, the discharge connector 40 insulates, electrically, the discharge tube 9 from the cylinder head 8 and comprises a tubular body 41, having a first end seated against the cylinder head 8 so as to have its interior maintained in fluid communication with the orifice 8*b* of the cylinder head 8, and a second end, against which is seated the head of said screw 8*a*, which is axially loosely disposed through the tubular body 41 and through the orifice 8*b* of the cylinder head 8.

The tubular body 41 is provided with a lateral opening 42, in which is affixed the inlet end 9*a* of the discharge tube 9, with the first and the second end of the tubular body 41 being electrically insulated from the adjacent parts defined by the cylinder head 8 and the head of the screw 8*a*, respectively.

In the illustrated construction, the tubular body 41 is cylindrical and metallic and provided with a radial opening 42.

According to the present invention, the electric insulation provided by the discharge connector 40 results in at least one of the parts defined by the tubular body 41 and the first and the second end of the discharge connector 40 being made of an electric insulating material.

In a way of carrying out the present invention, the electric insulation between the discharge connector 40 and particularly between the tubular body 41 and the parts defined by the cylinder head 8 and the head of the screw 8*a* is obtained by the provision of a washer 43*a*, made of an electric insulating material and provided between the first end of the tubular body 41 and a washer 43*b* between the second end of said tubular body 41 and the head of the screw 8*a*, said washers 43*a* and 43*b* being made of an electrically insulating material, such as polyester.

While only one possible embodiment has been illustrated for the present solution, it should be understood that other constructions are possible, such as a discharge connector incorporating the washers 43*a* and 43*b* and made of an insulating material, or said discharge connector 40 having its tubular body 41 made of an insulating material.

With the present solution, the existence of electric current leakage from the motor will reach no more the shell of the compressor through the discharge tube thereof, as it occurs in the prior art compressors, avoiding the risks of accidents mentioned above.

The invention claimed is:

1. A mounting arrangement for a discharge tube of a hermetic compressor, comprising:

a hermetic shell presenting a gas outlet and lodging a cylinder block to which is affixed, through screws, a cylinder head defining, internally, a gas discharge chamber; and a discharge tube presenting an inlet end in fluid communication with the gas discharge chamber through an orifice in the cylinder head, and an opposite end coupled to the gas outlet of the hermetic shell, wherein said discharge tube comprises a discharge connector affixed to the cylinder head through one of the screws by which the cylinder head is affixed to the cylinder block, said discharge connector receiving and securing the inlet end of the discharge tube, and electrically insulating the discharge tube of the cylinder head.

2. The arrangement according to claim 1, wherein the discharge connector comprises a tubular body having a first end seated against the cylinder head, in order to have its interior maintained in fluid communication with the orifice of the cylinder head, and a second end against which is seated the head of said screw which is axially loosely disposed through the tubular body and through the orifice of the cylinder head, said tubular body being provided with a lateral opening in which is affixed the inlet end of the discharge tube, with the first and second end of the tubular body being electrically insulated from the adjacent parts defined by the cylinder head and the head of the screw, respectively.

3. The mounting arrangement according to claim 2, wherein the electric insulation between the tubular body and the parts defined by the cylinder head and the head of the screw is obtained by the provision of a washer made of an electric insulating material and which is provided between the first end of the tubular body and the cylinder head and between the second end of said tubular body and the head of the screw.

4. The mounting arrangement according to claim 3, wherein the washers are made of polyester.

5. The arrangement according to claim 1, wherein the screw by which the cylinder head is affixed to the cylinder block extends through the orifice in the cylinder head that is in fluid communication with the discharge tube via the gas discharge chamber.

* * * * *

UNITED STATES PATENT AND TRADEMARK OFFICE

CERTIFICATE OF CORRECTION

PATENT NO. : 7,396,219 B2
APPLICATION NO. : 10/543798
DATED : July 8, 2008
INVENTOR(S) : Egidio Berwanger It is certified that error appears in the above-identified patent and that said Letters Patent is hereby corrected as shown below:

Title Page item 73 —

In the Assignee:

Please replace "Empresa Brasiliera De Compressores S.A. - Embraco" with

-- Empresa Brasileira De Compressores S.A. - Embraco --

Signed and Sealed this

Twenty-fourth Day of February, 2009

John Doll

JOHN DOLL
*Acting Director of the United States Patent and Trademark Office*